US005433680A

United States Patent [19]

Knudsen

[11] Patent Number: 5,433,680

[45] Date of Patent: Jul. 18, 1995

[54] ELLIPTICAL PATH PEDALING SYSTEM

[76] Inventor: Paul D. Knudsen, 3823 W. Sandra Ter., Phoenix, Ariz. 85023

[21] Appl. No.: 270,761

[22] Filed: Jul. 5, 1994

[51] Int. Cl.[6] ..... A63B 21/00; F16H 3/44

[52] U.S. Cl. ..... 482/57; 482/63; 74/63

[58] Field of Search ..... 482/51, 52, 53, 57, 482/63, 62; 74/29, 45, 48, 53, 842, 63; 280/259, 260; 474/50, 70

[56] References Cited

U.S. PATENT DOCUMENTS

| | | | |
|---|---|---|---|
| 667,920 | 2/1901 | Perkins | 82/57 |
| 3,865,366 | 2/1975 | Stantial | 482/57 |
| 3,995,508 | 12/1976 | Newell | 74/244 |
| 4,181,043 | 1/1980 | Waddington | 74/750 B |
| 4,753,435 | 6/1988 | Carnielli | 482/57 |
| 4,800,768 | 1/1989 | Kazuta . | |
| 5,044,627 | 9/1991 | Huang | 482/62 |
| 5,050,864 | 9/1991 | Pertramer | 482/62 |
| 5,099,706 | 3/1992 | Irvin . | |

*Primary Examiner*—Stephen R. Crow

*Attorney, Agent, or Firm*—LaValle D. Ptak

[57] ABSTRACT

An elliptical path pedaling system uses two mutually perpendicular intersecting guideways with a circular drive member pivotally attached at its center to a follower, mounted for reciprocal movement within the first guideway. A second follower is pivotally attached to the circular drive member at a predetermined radial distance from the center of said drive member for reciprocal movement in the second guideway. A pedal crank is attached to the drive member to rotate it about the center. As the drive member rotates, the reciprocating movements of the two followers in the perpendicular guideways cause the drive member to move back and forth in the path of the first guideway. A pedal crank attached to the reciprocating drive member follows an elliptical path. A chain or other suitable drive transfer device is coupled between the drive member and a circular driven member, which is rotated about its center and is mounted in a fixed position relative to the guideways. Consequently, the elliptical path of the pedaling system is transferred to a circular driven output for utilization as a bicycle drive or exercise device.

24 Claims, 3 Drawing Sheets

ELLIPTICAL PATH PEDALING SYSTEM

BACKGROUND

Pedaling systems for transferring leg-driven power from the feet of a user to propulsion devices or exercise devices are well known. In most cases a circular drive sprocket gear is coupled by a chain to a driver sprocket gear, to rotate the rear wheel of a bicycle or to rotate a flywheel in an exercise device. Pedal cranks are located on each side of the drive sprocket gear, oriented 180° apart from one another. Thus, by means of a circular reciprocating motion, the user of the device rotates the drive sprocket. Other applications, however, include simple devices such as recreational paddle boats and miniature cars and tractors employed as toys for small children.

In some cases, the circular reciprocating motion imparted by the feet of the user to the pedals is linked by means of elongated levers operated from axle offsets at the drive end of the device and coupled to comparable offset axle connections for driven wheels. The driving motion, however, is the same. The pedal cranks rotate about a fixed axis or center line, around which either a sprocket wheel or the drive lever offsets are rotated to produce the driving power to move the device forward.

In the case of bicycles, additional enhancements, which in no way affect the manner in which the original power is applied, include derailleur sets and multiple gears for enabling adjustment of the energy input required to rotate the rear wheel. These mechanisms, however, do not in any way alter the circular path which is followed by the pedals on the ends of the offset cranks which are used to rotate the basic drive member, whether it is a sprocket wheel or some other rotating device from which the input power is derived for application to an output-driven wheel or the like.

Exercise machines, which employ a similar type of action, have been developed in an effort to simulate the motions a person goes through in climbing stairs. Stair climbing machines typically have a pair of side-by-side "steps", which are alternately negotiated by the right and left feet, respectively, of a user. The force required to press down the step on one side, is employed, in part, to raise the step on the other side; so that as a person goes through the alternating left and right stepping sequence, differing amounts of energy are expended in accordance with the setting of the machine resistance to provide the desired exercise. Typically, the two "steps" are coupled to some type of a resistive flywheel to provide the level of resistance desired by the person using the device. In such stair climbing machines, however, the actual motion which normally is employed by a person in climbing up an actual set of stairs is not attained. In fact, the up and down motion which is applied is more akin to the movement which would be undertaken if a person were to walk down a set of stairs backwards. It is not the normal elliptical motion, which a person climbing a conventional set of stairs undergoes with each foot/leg motion operating in alternation.

Variable transmissions located between the pedal input of a bicycle and the output sprocket or wheel, without using a conventional derailleur device, are described in the U.S. patents to Kazuta U.S. Pat. No. 4,800,768 and Irwin U.S. Pat. No. 5,099,706. In both of these patents, however, the pedal path which is employed is a conventional circular path. Both of the patents describe a variable transmission, which uses two mutually perpendicular racks moved by a pinion coupled to the pedal shaft. In the devices of both of these patents the pinion only engages one of the racks on one side at a time, except for a brief time of transition from one rack to the next one in sequence. In the operation of the transmission devices of these patents, the racks are not continually moved by the pinion; and they are not engaged simultaneously, with the exception of the brief transition time mentioned.

It should be noted that a circular pedaling motion, particularly as applied to a bicycle, is highly inefficient. Maximum power is attained if the leg moves in a generally linear direction as it is pressed downwardly from the hip. When a circular motion is employed, as in the case of a conventional circular pedaling arrangement used on bicycles, some of the available power or force is dissipated in the first several degrees and the last several degrees of the full 180° power movement from a position nearest the body of the user to a fully extended position, just prior to the return stroke or lifting of the leg. Consequently, if a more efficient pedaling path utilizing a more nearly linear stroke, as opposed to circular, can be devised, a greater amount of useful energy can be employed to rotate a drive wheel of a bicycle or other device. In addition, if an elliptical motion can be imparted to the operation of a stair climbing machine or the like, a more natural exercise of muscles can be attained, since such a motion more nearly simulates the actual motion encountered during climbing of conventional stairs.

It is an object of this invention to provide an elliptical path pedaling system, which overcomes the disadvantages of the prior art noted above, which is effective in operation, is easy to use, and is capable of adaptation into a variety of different devices.

SUMMARY OF THE INVENTION

It is an object of this invention to provide an improved pedaling system.

It is an additional object of this invention to provide an improved elliptical path pedaling system.

It is another object of this invention to provide an improved elliptical path pedaling system which produces rotary motion from an elliptical pedaling motion.

It is a further object of this invention to provide an improved power stroke in a pedaling system for delivering greater power for a longer period of time during each pedal operation cycle.

In accordance with a preferred embodiment of the invention, an elliptical path pedaling system includes a first drive member. A crank is attached to the first drive member to rotate it about its center. First and second perpendicular intersecting linear guideways have first and second follower members in them for reciprocal movement in the respective guideways. The first follower member is pivotally attached to the center of the drive member; and the second follower member is pivotally attached to the drive member at a point a fixed radial distance from the center of the drive member. When the drive member is rotated by the crank, the free end of the crank, to which a pedal typically is attached, follows an elliptical path. The drive member is coupled with a circular driven member by interconnecting the two with a transfer member, such as a bicycle chain or the like.

DETAILED DESCRIPTION

Figure 1:
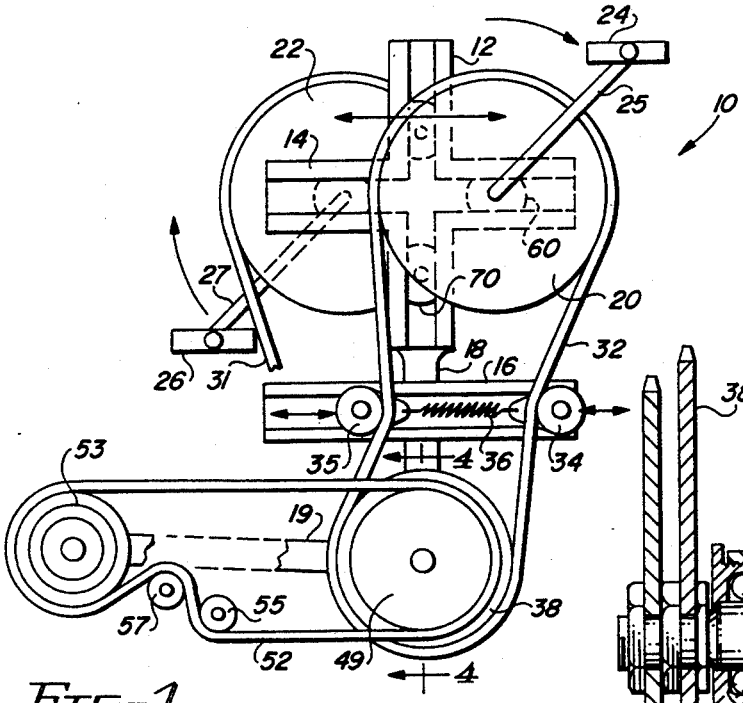
FIG. 1 is a side view of a preferred embodiment of the invention.

Before entering into a discussion of the preferred embodiment of the invention shown in the drawings, a brief discussion of the standard pedaling motion commonly used on a bicycle is considered in order. In a conventional bicycle, a circular drive system is employed. Power is applied to the drive gear by means of an attached lever or crank, causing the gear to rotate on a fixed central axis and to draw a chain around it, thus transmitting power to another driven gear. The fulcrum point of the crank lever is at the center of the gear. This creates a circular path at the end of the lever where the pedal is attached. The circular rotation generates its peak power during the downward or forward power stroke; and typically, this stroke is assumed to be 180° of the 360° rotation. The other 180° is for the return of the foot and leg back to the original starting point for the power stroke. The crank levers are attached to both sides of the drive gear and are 180° out of phase with one another; so that as one leg is entering the power stroke, the other leg is just entering the return stroke, and vice-versa.

The power stroke for a circular pedaling system, however, delivers peak power during only approximately fifty percent or sixty percent of this 180° power stroke. This peak power starts, generally, from a point approximately 15° past the top dead center or start and ends at approximately 10° before the bottom or dead center end of the power stroke.

Reference now should be made to the drawings, in which the same reference numbers are used throughout the different figures to designate the same components.

In the rotation device illustrated in detail in FIGS. 1, 2 and 4 through 8 of this application, the rotation of the pedaling system is an elliptical rotation, which is capable of generating peak power during seventy-five to eighty percent of the 180° power stroke, due to the more linear path followed by the pedals of the device. Because the path is more linear, maximum power is realized earlier in the "rotation" and is maintained for a longer period of time, due to the longer pedal stroke for drive gears of the same size used in common circular pedal drives.

As illustrated in FIG. 1, an elliptical path pedaling system 10 consists of a pair of circular drive gears or drive sprockets 20 and 22, as opposed to a single drive gear for a conventional circular rotation pedaling device. One crank lever and one pedal is attached to rotate each of the drive gears 20 and 22 about their centers, as illustrated most clearly in FIGS. 1 and 8. As illustrated, a crank lever 25 is attached at one end to the center of the drive gear 20 and it has a pedal 24 rotatably mounted on the other end. A similar arrangement is made of a crank lever 27 and pedal 26 for the gear 22. As illustrated in both FIGS. 1 and 8, the crank levers 25 and 27 preferably are located 180° out of phase with one another in operation of the device. It readily is apparent that there is no direct connection between the drive gears or drive sprockets 20 and 22; so that they are free to move back and forth relative to one another in the direction of the double-ended arrow shown in FIG. 1.

Each of the drive gears or sprockets 20 and 22 are attached at two spaced points, respectively, to a pair of sliding members 60 and 70 for the gear 22 and 60' and 70' for the gear 22. The pairs of respective sliding members are held captive in corresponding raceways or guideways 14 and 12, respectively. These pairs of guideways, shown most clearly in FIGS. 1 and 8, intersect one another at 90° or right angles, and cross at the center of each pair to form an "X". These "X" shaped raceways or guideways 12/14 and 12'/14' create the elliptical paths at the ends of the levers 25 and 27 where the pedals 24 and 26 are attached. The balance of this description primarily will be made in conjunction with the drive gear or sprocket 20 and lever 25 and pedal 24. It should be noted, however, that an identical but 180° out of phase, motion takes place for the drive gear 22; and the two operate in conjunction with one another to provide the desired output.

As illustrated in FIG. 1, the drive gear 20 is coupled by means of a belt or chain (in most cases, preferably, a chain) 32 to a driven idler gear or sprocket 38, which rotates about its center. An output gear 49, which is attached to and rotates with the driven gear 38, then applies power to another chain 52, which may be coupled through a conventional derailleur mechanism 55/57 to a derailleur gear 53 for driving the rear wheel of a bicycle or other suitable device.

Since the frame of a bicycle, or other device which is driven by the mechanism shown in FIG. 1, may take any one of a number of standard configurations, the actual frame has not been shown. It should be noted, however, that, for the purposes of understanding the use of the mechanism shown in FIGS. 1, 2 and 4 through 8, the guideways or raceways 12/14 and 12'/14' are rigidly affixed back-to-back to one another and to the support frame for the bicycle. Similarly, the raceways 12/14 and 12'/14' are rigidly connected by means of a tubular support 18, for example, to a housing 43. A rotating shaft 42 carried by bearings 45 and 47 is mounted in the housing 43 for rotation by the driven sprocket gear 38 coupled by the chain 32 to the drive gear 20 and by the driven sprocket 40 coupled by a similar chain 31 to the drive gear 22. This is shown in detail in FIG. 4.

To hold the drive gears 20 and 22 in operative position with respect to the raceways 12/14 and 12'/14', the sliding members 60 and 60' are pivotally connected by pivots 61 and 61' to the centers of the respective drive gears 20 and 22 on the sides opposite the connection of the crank levers 25 and 27. Similarly, a pivotal connection of the sliding members 70 and 70' is made by means of pivots 71 and 71', respectively, at points close to the peripheries of the drive gears 20 and 22, as illustrated most clearly in FIG. 8.

The distance between the pivots 61 and 71 (and also between 61' and 71') establishes the elongation of the shape of the elliptical path which is taken by each of the pedals 24 and 26 in the operation of the device. When the two pivot points 60 and 70 are close together, the ellipse approximates that of a circle. As the distance (25A in FIGS. 3A to 3H) between these two pivot points increases, the elliptical path, which is generated by the device in its major axis in the direction of the double-ended arrow in FIG. 1, becomes "flatter" or more elongated to permit a more linear path for the pedal. Clearly, with any given device, the elongation length is limited by the diameter of the driven gears 20 and 22. Thus, the diameter of the driven gears is selected to provide the best compromise between gear size, shape of the power stroke, length of the power stroke, and other design limitations for effecting optimum operation.

Figure 2:
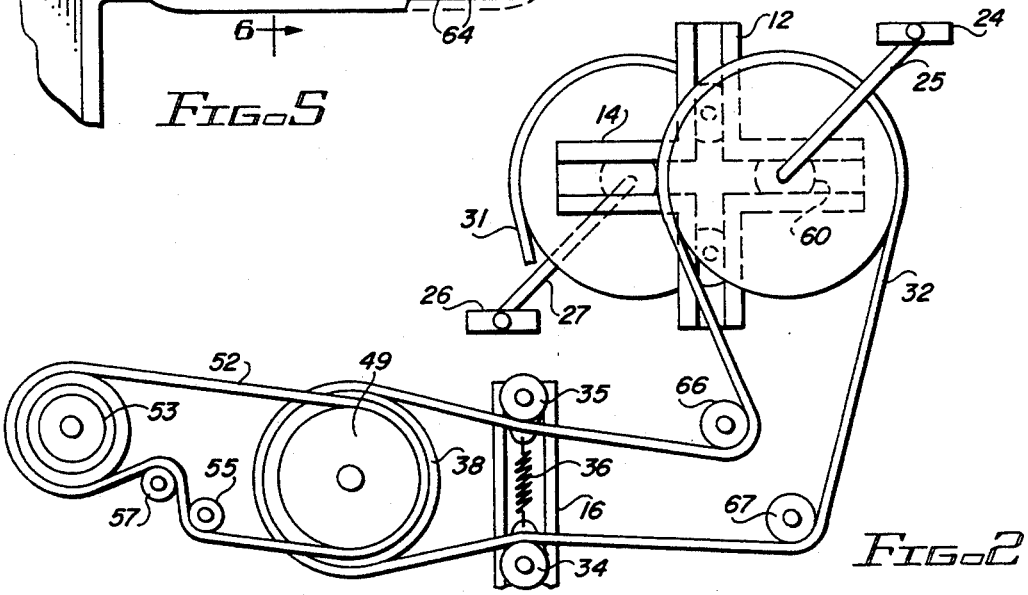
FIG. 2 is a side view of a variation of the embodiment shown in FIG. 1.
Figure 3A:
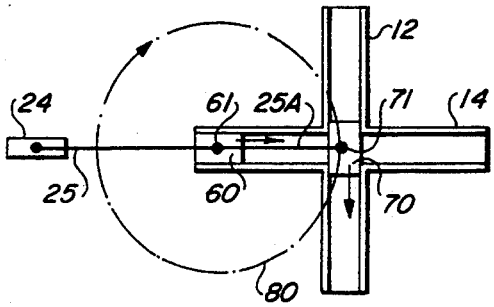
FIGS. 3A through 3H are diagrammatic representations of the operation of the embodiment shown in FIGS. 1 and 2.
Figure 8:
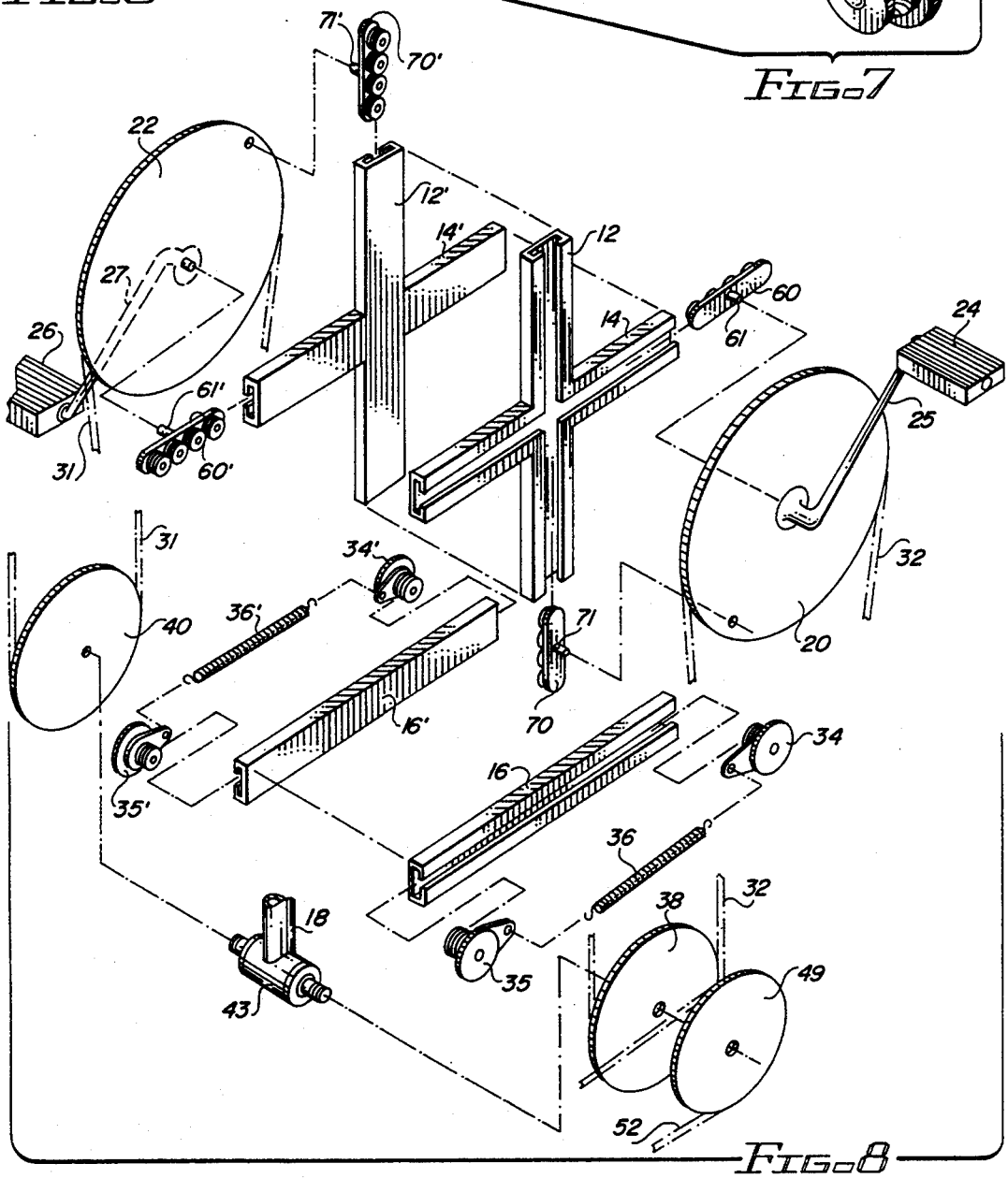
FIG. 8 is an exploded view of a portion of the embodiment shown in FIGS. 1 and 2.

Reference now should be made to FIGS. 3A through 3H, which provide a diagrammatic representation of the path of movement of the pedal 24 on the end of the crank lever 25 during operation of the device. A similar identical movement (180° out of phase) is also present for the path taken by the pedal 26 on the drive gear 22. In FIG. 3A, the pedal 24 and crank 25 are illustrated at the start of the "power" stroke, which in the orientation shown in FIGS. 3A through 3H and in FIGS. 1, 2 and 8, is from left to right in a generally horizontal plane. This is the orientation which would be used in a recumbant bicycle. If a drive of a conventional bicycle were to be replaced with the drive mechanism shown in FIGS. 1, 2 and 8, the guideway or raceway 14 would be vertically oriented, rather than horizontally oriented. This also would be the orientation for a "stair climbing" exercise device. In all other respects, the operation of the device is the same, whether it is used as a recumbant device or as a vertically oriented device.

As shown in FIG. 3A the beginning of the power stroke takes place in the direction of the arrow of the circle 80. It should be noted that the circle 80 is the circle which is circumscribed by the pivot 71 on the sliding follower 70. This is near the circumference of the gear 20. When the stroke commences to rotate the pedal 24 clockwise in the direction of the arrow of the circle 80, the slide follower 70 moves from the center position at the cross point of the guideways or raceways 12/14 downwardly in the direction of the arrow, as shown. Similarly, the center point or pivot 61 on the slide follower 60 commences to move from left to right in the direction of the arrow shown. When the pedal 24 has been rotated 45°, the parts assume the relative positions shown in FIG. 3B.

At the point of 90° rotation, the slide follower 60 is located at the center of the cross point of the guideways 12 and 14; and the follower 70 is at the lowest point of the guideway 12, as illustrated. An additional 45° rotation, as shown in FIG. 3D, causes the follower 60 to move approximately half way along the length of the right-hand end of the raceway 14, and the follower 70 moves a lesser extent upwardly.

Figure 3E:
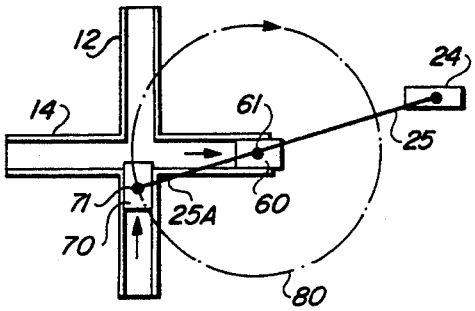
Figure 3B:
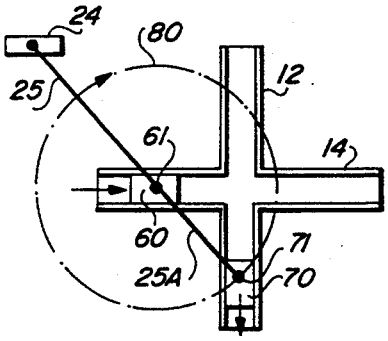
Figure 3F:
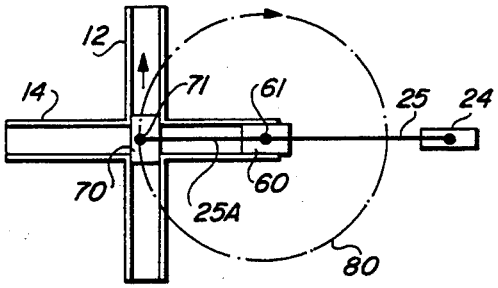
Figure 3C:
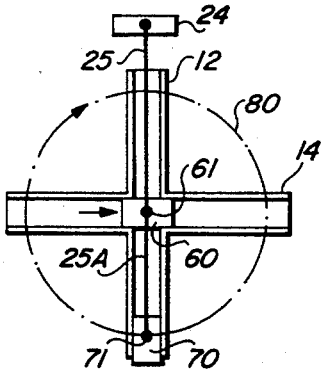
Figure 3G:
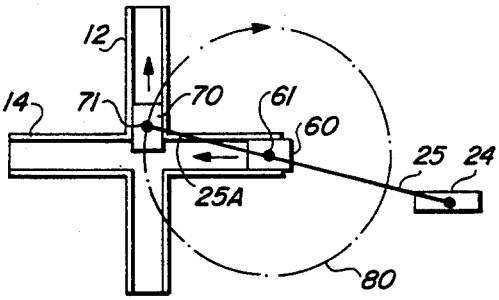
Figure 3D:
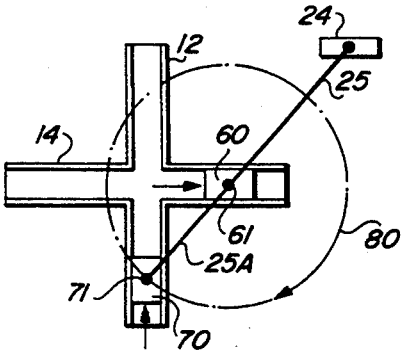
Figure 3H:
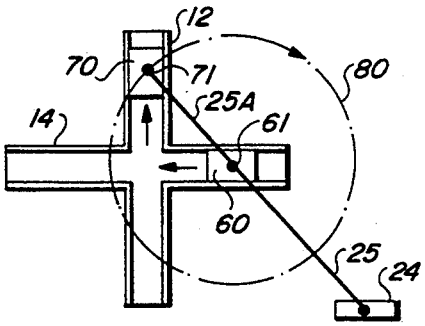

Continued rotation an additional 45° to a position which is 180° from that shown in FIG. 3A is shown sequentially in FIGS. 3E and 3F. It should be noted that the pedal 24 in FIG. 3F is extended far to the right, forming the outward end of the major axis of the ellipse. This also is the end of the 180° power stroke. Continued rotation to bring the pedal 24 back to its starting position is illustrated in part in FIGS. 3G and 3H, which show the first 45° of the "return" 180°.

In all of these figures, the distance marked as 25A is the distance between the pivot points 61 and 71 which are attached, respectively, to the slide follower members 60 and 70. It is readily apparent from an examination of FIGS. 3A, 3C and 3F, for example, that the horizontal distance from the cross point center of the guideways 12 and 14, which the pedal 24 travels is nearly twice the vertical distance the pedal travels in its rotation. This means that the major axis (the horizontal axis) of the elliptical path taken by the pedal 24 is approximately twice that of the minor axis (the vertical axis) of the ellipse. Consequently, the power stroke which takes place between the positions shown in FIG. 3A and FIG. 3F is more linear than a conventional circular power stroke. This permits a longer steady application of power by a person who is pedaling the device.

The mechanical advantage of the force applied to the pedal 24 (and also the pedal 26) is increased beyond that which is realized from the same force applied to a gear rotating on a fixed axis. The elliptical path described by the pedal 24 in conjunction with FIGS. 3A through 3H, although it is no longer in length of stroke than a conventional circular stroke as measured between the start and stop pedal positions (namely, FIGS. 3A and 3F), results in a longer, flatter power curve. Consequently, more power is transferred to the chain 32 (and also 31); and more physical chain length is pulled past a given point for each power stroke.

It should be noted that as power is applied to the pedal when it is at the beginning of its power stroke, as shown in FIG. 3A, the sliding member 70 on the opposite side of the gear 20 slides downwardly toward the outer end of the raceway 12, as described above. When this occurs, it places the fulcrum point of the lever 25 at the outer edge of the gear 20, creating a greater mechanical advantage. As the pedal 24 travels through the elliptical power path, the gear 20 not only is rotated about a non-fixed phantom axis, but it also travels forward (from left to right, as shown in FIGS. 3A through 3F) along the line of the second slider follower 60, as described. In combination, this functions to transmit power to the chain 32 by both circular rotation and forward travel of the gear 20 during the power stroke. Consequently, during a complete cycle of the downward power stroke and an upward return stroke of the pedal, the gear 20 rotates 360° clockwise in a circular manner, and further orbits the cross point of the raceways 12 and 14, 360° in a counterclockwise circular manner, the phantom center axis of the gear 20 always describing the orbit path. To accommodate for the relative distance change between the driven gear 20 and the fixed idler gear 38, to which the chain 32 is transmitting power, chain tension adjusters 34 and 35 are used.

Reference once again should be made to FIGS. 1 and 4 through 8, where the manner of coupling the drive described in conjunction with the diagrammatic representations of FIGS. 3A through 3H is illustrated. The chain 32 is fed from the drive gear 22 to an idler gear or sprocket 38, located directly below (as shown in FIGS. 1 and 8) the center of the intersection of the two raceways or guideways 12 and 14. Support for the idler gear 38 and the guideways 12/14 may be made by means of a frame member 18, illustrated in FIGS. 1 and 4, for example.

Sufficient space is provided between the outer peripherys of gears 20 and 38 to allow for a chain tensioning device mounted on another raceway 16 to be installed. The chain tensioning raceway 16 is attached to the frame member 18 in the position shown in FIG. 1, and includes a pair of freely movable sprockets 34 and 35, which are spring biased toward one another by means of a spring 36, into engagement with the outside of the chain 32 to pull it into the position shown in FIG. 1.

The idler gear 38 is rigidly attached through the shaft 42 (FIG. 4) to another idler gear 40 driven by the chain 31 for the opposite drive gear 22. Consequently, the idler gear set 38, 40 serves to synchronize the front and back, or left and right side, pedals 24 and 26, since the rotation of the drive gears 20 and 22 then necessarily is synchronized by the common rotation of the shaft 42, to which the idler gears 38 and 40 are attached.

Figure 4:
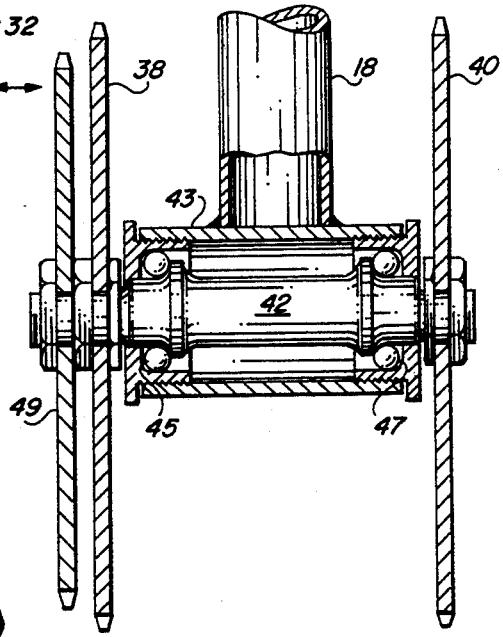
FIG. 4 is a cross-sectional view taken along the line 4—4 of FIG. 1.

The useful power output from the device is obtained from a secondary drive gear 49, illustrated in FIGS. 1, 4 and 8, which operates a chain 52 coupled through a conventional derailleur, illustrated diagrammatically as 55 and 57, to an output derailleur gear 53. The gear 53 is mounted on a shaft connected to a frame member 19, which in turn is connected in common between the shaft of the gear 53 and the housing 43 to which the frame member 18 is attached. The relative orientations of the various parts may be modified in order to adapt the device to different configurations, depending upon the desired use and shape which is to be incorporated with the remainder of the bicycle or other device driven by the mechanism shown in FIGS. 1 and 4 through 8. Since the derailleur mechanism 55 and 57 and the output derailleur gear 53 are conventional, no details of the manner of connecting these gears and operating them are considered necessary here, since the operation of this portion of any conventional bicycle is not dependent upon the source of the power for the drive chain 52.

Since the two pedal systems operating the two driven gears 20 and 22 are placed back to back to make the system functional, and since there is no common axis point at the two primary drive gears to couple these pedal systems together, the two idler gears 38 and 40 are fixed to the common rotating axle 42 to take the power from the chains 31 and 32 and synchronize the pedals 24 and 26 180° apart. A similar tensioning device, such as the device 16, 34, 35 and 36, is used for the chain 31. Since this tensioning device is a mirror image of the one shown for the chain 32, it has not been illustrated in FIG. 1, in order to avoid unnecessary cluttering of the drawing.

Figure 5:
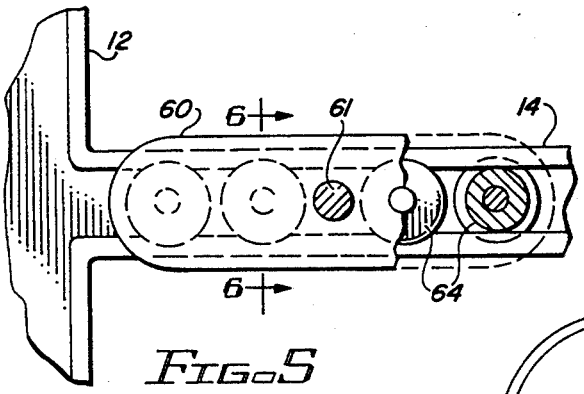
FIG. 5 is a partially cut away enlarged detail of a portion of the embodiment shown in FIG. 1.
Figure 6:
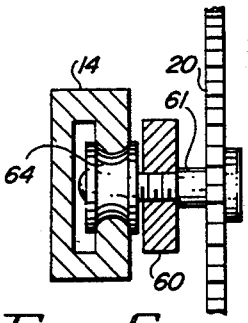
FIG. 6 is a cross-sectional view taken along the line 6—6 of FIG. 5.
Figure 7:
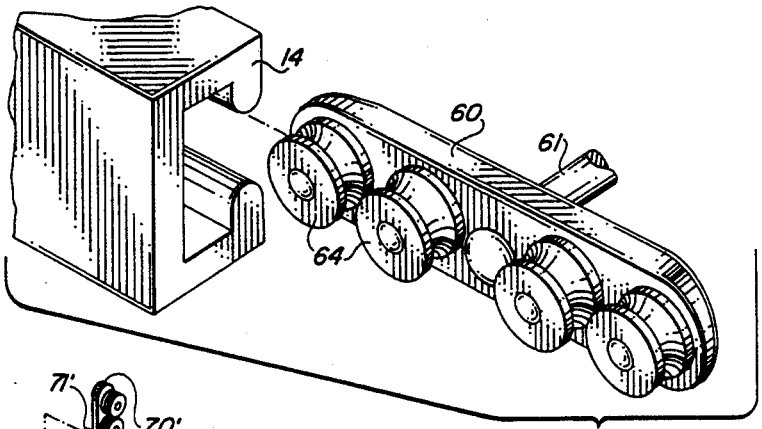
FIG. 7 is a perspective view of the portion of the embodiment shown in FIGS. 5 and 6.

FIGS. 5, 6 and 7 illustrate one type of a slider follower 60, which may be employed for all of the slider followers 60, 70, 60′ and 70′, if desired. As illustrated, the follower includes a main body portion 60, which has four spaced rotating wheels or bearings 64 mounted on it. The wheels are concave in cross section, as illustrated most clearly in FIGS. 6 and 7, and ride on an inwardly turned flange formed in the guideway or raceway 14, as illustrated most clearly in FIGS. 6 and 7. The main body portion 60 is pivotally rotated on a shaft 61, which, as shown in FIG. 6, is attached to the gear 20. Comparable attachments and similar construction are employed for all of the sliders 60, 70, 60′ and 70′ to provide a nearly friction-free operational movement as the device is operated. It should be noted, however, that the rotating wheels or bearing-like device which is illustrated in FIGS. 5, 6 and 7, may be replaced with other types of low friction sliding devices, if desired. For the operation of the invention, the ideal situation is to have a zero friction movement of the sliders 60, 70, 60′ and 70′; so that the maximum amount of the energy expended in rotating the pedals 24 and 26 ultimately is applied to the driven idler gears 38/40.

FIG. 2 illustrates a configuration which may be employed, if desired, as a different orientation of the parts shown in FIG. 1. In the device of FIG. 2, the idler assembly 38/40 is not located directly beneath the lower end of the guideway or raceway 12, but instead is offset toward the left. If this is done, another set of fixed idler gears 66 and 67 is employed for the chain 32 (and a similar set of gears, not shown, is used for the chain 31) to then feed the chain 32 back to the idler assembly 38, 40, 49, as illustrated. In all other respects, the mechanism of FIG. 2 operates in the same way as the mechanism of FIG. 1; and the elliptical motion which is attained by the operation of the pedals 24 and 26 is the same as described above in conjunction with the embodiment shown in FIGS. 1, 3 and 8.

In the system described, the gears 20 and 22 have the same diameter as do the idler gears 38 and 40. Also, the crank levers 25 and 27 are of the same length for the most efficient operation of the system.

The foregoing description of the preferred embodiment of the invention should be considered as illustrative and not as limiting. Various changes and modifications will occur to those skilled in the art for performing substantially the same function, in substantially the same way, to achieve substantially the same result, without departing from the true scope of the invention as defined in the appended claims.

I claim:

1. An elliptical path pedaling system including in combination:

at least a first drive member having a center;

a first crank attached to said first drive member for rotating said first drive member about the center thereof;

a first linear guideway;

a second linear guideway intersecting said first linear guideway at right angles thereto;

a first follower member pivotally attached to the center of said first drive member and mounted for reciprocal movement in said first guideway;

a second follower member pivotally attached to said first drive member at a point a predetermined radial distance from the center of said first drive member and mounted for reciprocal movement in said second guideway;

a circular driven member; and a first drive transfer member interconnecting said first drive member with said driven member to rotate said driven member as said drive member is rotated about the center thereof.

2. The combination according to claim 1 wherein said first and second linear guideways intersect at the centers thereof.

3. The combination according to claim 2 wherein said first crank has first and second ends, the first end of which is connected to said first drive member.

4. The combination according to claim 3 further including a first foot pedal attached to the second end of said first crank.

5. The combination according to claim 4 wherein said first drive member is a circular drive member.

6. The combination according to claim 1 wherein said first crank has first and second ends, the first end of which is connected to said first drive member.

7. The combination according to claim 6 further including a first foot pedal attached to the second end of said first crank.

8. The combination according to claim 1 wherein said first drive member is a circular drive member.

9. The combination according to claim 1 wherein said first drive transfer member is a chain, said first drive member is a sprocket gear, and said driven member is a sprocket gear with said chain interconnecting said drive member and said driven member.

10. The combination according to claim 1 further including a second drive member having a center;

a second crank attached to said second drive member for rotating said second drive member about the center thereof;

a third linear guideway coupled parallel to said first linear guideway;

a fourth linear guideway coupled parallel to said second guideway and intersecting said third linear guideway at right angles thereto;

a third follower member pivotally attached to the center of said second drive member and mounted for reciprocal movement in said third guideway;

a fourth follower member pivotally attached to said second drive member at a point said predetermined radial distance from the center of said second drive member and mounted for reciprocal movement in said fourth guideway;

a second drive transfer member interconnecting said second drive member with said driven member to rotate said driven member as said first and second drive members are rotated about the centers thereof.

11. The combination according to claim 10 wherein said first and second cranks are attached to said first and second circular drive members, respectively, at positions 180° out of phase with one another.

12. The combination according to claim 11 wherein said first and second linear guideways intersect one another at the centers thereof, and said third and fourth linear guideways intersect one another at the centers thereof, with said first and third linear guideways being mounted in back-to-back relationship, said second and fourth linear guideways being mounted in back-to-back relationship and said first and second drive members being located on opposite sides, respectively, of said back-to-back mounted guideways.

13. The combination according to claim 12 wherein said first and second cranks each have first and second ends, with the first ends thereof connected to said first and second drive members, respectively.

14. The combination according to claim 13 further including first and second foot pedals attached, respectively, to the second ends of said first and second cranks.

15. The combination according to claim 14 wherein said first and second cranks each have the same predetermined length.

16. The combination according to claim 15 wherein said first and second drive transfer members comprise first and second chains, respectively, and said circular driven member includes first and second driven sprocket gears on a common shaft, with said first and second drive members comprising first and second sprocket gears interconnected with said first and second driven sprocket gears by said first and second chains, respectively.

17. The combination according to claim 10 wherein said first and second cranks each have first and second ends, with the first ends thereof connected to said first and second drive members, respectively.

18. The combination according to claim 17 further including first and second foot pedals attached, respectively, to the second ends of said first and second cranks.

19. The combination according to claim 18 wherein said first and second cranks each have the same predetermined length.

20. The combination according to claim 10 wherein said first and second drive transfer members comprise first and second chains, respectively, and said circular driven member includes first and second driven sprocket gears on a common shaft, with said first and second drive members comprising first and second sprocket gears interconnected with said first and second driven sprocket gears by said first and second chains, respectively.

21. The combination according to claim 10 wherein said first and second drive members are circular drive members having the same diameter.

22. The combination according to claim 21 wherein said first and second cranks each have the same predetermined length.

23. The combination according to claim 22 wherein said first and second cranks each have first and second ends, with the first ends thereof connected to said first and second drive members, respectively.

24. The combination according to claim 23 further including first and second foot pedals attached, respectively, to the second ends of said first and second cranks.

* * * * *